US005624110A

United States Patent [19]

Fyler

[11] Patent Number: 5,624,110

[45] Date of Patent: Apr. 29, 1997

[54] CUT SEGMENT PICK-UP ASSEMBLY

[75] Inventor: Donald C. Fyler, Needham, Mass.

[73] Assignee: The Charles Stark Draper Laboratory, Inc., Cambridge, Mass.

[21] Appl. No.: 553,874

[22] Filed: Nov. 6, 1995

[51] Int. Cl.[6] ..... B65H 3/22

[52] U.S. Cl. ..... 271/18.3; 221/213; 198/692

[58] Field of Search ..... 271/18.3, 267; 221/213; 198/692, 693

[56] References Cited

U.S. PATENT DOCUMENTS

| | | | |
|---|---|---|---|
| 3,176,979 | 4/1965 | Engelmann | 271/18.3 |
| 4,505,468 | 3/1985 | Heisler | 221/213 |
| 4,645,193 | 2/1987 | Walton et al. | 271/18.3 |
| 5,114,132 | 5/1992 | Arato et al. | 271/18.3 |
| 5,356,126 | 10/1994 | Bayer et al. | 271/18.3 |
| 5,463,921 | 11/1995 | Bellio et al. | 83/151 |
| 5,496,021 | 3/1996 | Bellio et al. | 271/18.3 |

FOREIGN PATENT DOCUMENTS

| | | | |
|---|---|---|---|
| 0110568 | 8/1979 | Japan | 271/18.3 |

*Primary Examiner*—H. Grant Skaggs
*Attorney, Agent, or Firm*—Lappin & Kusmer LLP

[57] ABSTRACT

A segment pickup apparatus for handling material segments. The apparatus includes a frame and at least one pair of picker assemblies coupled to the frame. Each of the picker assemblies includes a linear array of carding elements, and each of the carding elements is resiliently coupled to one of the picker assemblies and is positionable relative to the frame in a resting position and in a picking position. Each of the carding elements includes a base portion and a linear array of substantially parallel, elongated, resilient needle-like elements extending from the base portion to a distal tip. When a carding elements is positioned in the resting position, the distal tips of that carding element lie above a picking plane, and when a carding elements is positioned in the picking position, the distal tips of that carding element lie substantially in the picking plane. The picker assemblies are disposed such that the carding elements are arranged in pairs, and in each pair the needle-like elements of one carding element slant towards a first direction and the needle-like elements of the other carding element slant towards a second direction. The segment pickup apparatus further includes a carding actuator device for positioning pairs of carding elements in the resting position and in the picking position, and also includes a picker actuator device for displacing the picker assemblies relative to the frame in the first direction and in the second direction.

12 Claims, 7 Drawing Sheets

CUT SEGMENT PICK-UP ASSEMBLY

CROSS-REFERENCE TO RELATED APPLICATION

This Application is related to U.S. patent application Ser. No. 08/027,098, entitled METHOD AND APPARATUS FOR AUTOMATED HANDLING OF CUT MATERIAL, filed Mar. 5, 1993, now U.S. Pat. No. 5,463,921 and assigned to the assignee of the present invention, and to U.S. patent application Ser. No. 08/325,484, entitled METHOD AND APPARATUS FOR AUTOMATED HANDLING OF CUT MATERIAL filed Oct. 19, 1995, now U.S. Pat. No. 5,496,021 and assigned to the assignee of the present invention, and which is a division of U.S. patent application Ser. No. 08/027,098. Those applications are incorporated by reference herein.

BACKGROUND OF THE INVENTION

The present invention relates generally to systems for automated or computer controlled assembly of cut material segments, such as segments cut from a sheet of limp material. More particularly, the invention relates to apparatus for picking up and transporting such cut material segments. By way of example, the invention may be used in the course of assembling cloth panels (cut segments) to form a garment, or it may be used in the course of resin transfer modling of articles, where for example graphite fiber woven panels (cut segments) are first cut, then placed in a mold and finally impregnated with an epoxy resin.

In the limp material automated assembly field, a cutting device, such as a laser, typically cuts individual material segments from a sheet of material and then a picking device extracts the cut segments and transports them to a staging area where they are assembled in a desired manner. The cutting device is typically controlled to cut several segments from a sheet in a manner which minimizes the amount of scrap material between the segments since such material is generally not usable. After the segments have been cut from a sheet, the picking device extracts the cut segments from the sheet, and preferably does so without disturbing the remaining cut segments and without disturbing the scrap. The picking device then transports the cut segments to the staging area and deposits them at predetermined locations.

Once a desired collection of cut segments have been precisely positioned at the staging area, they may be assembled together in various combinations, perhaps with other materials. One such type of assembled combination is commonly referred to as a "preform". The preforms may then be used to produce various products and articles.

Although cutting and sewing generally are old and well-known arts, there is a continuing need to develop improved systems for automated assembly, as well as to adapt to the special features of newly developed limp materials. Many of these new materials are lightweight and delicately woven, yet are tough and durable. Such materials may include synthetic materials used for example in outer-wear, or epoxy-graphite materials (commonly referred to as "composites") which are used in a variety of applications such as resin transfer molding processing, and in the production of goods such as sporting goods, radomes, and the like.

In the construction of composite parts by resin transfer molding processing, a preform is first assembled from material segments cut from a sheet of dry woven composite materials such as fiberglass or carbon fibers. The assembled preform is then placed in a mold and injected with resin to produce the finished part. Such preforms can be difficult and time consuming to make since they must be precisely assembled for quality control reasons, and since the composite materials used in their construction tend to be loosely woven and tend to distort and unravel at the slightest of handling thereby complicating the process of transporting the cut segments. There is therefore a need for improved systems for picking up and transporting segments which have been cut from a sheet of delicate, limp material, while maintaining the shape and integrity of the transported segments and also without disturbing other segments which may have been cut from the sheet and without disturbing the scrap.

The above-referenced U.S. patent application Ser. Nos. 08/027,098 and 08/325,484, and corresponding PCT International Application No. PCT/US94/00178 (International Publication No. WO 94/20399), which are hereby incorporated by reference, teach a method and an apparatus for handling cut material segments. However, there remains a need for improved inexpensive systems that can, in a highly repeatable manner, extract material segments which have been cut from a sheet of material without disturbing the sheet, and that can transport such segments without distorting their shape, and that can precisely deposit such segments at a desired location.

It is therefore an object of the present invention to provide an inexpensive segment pickup apparatus for the automated handling of limp material segments.

Other objects and advantages of the present invention will become apparent upon consideration of the appended drawings and description thereof.

SUMMARY OF THE INVENTION

In one aspect the invention provides a segment pickup apparatus for handling segments which have been cut from a sheet of material. The apparatus includes a frame and at least one pair of picker assemblies coupled to the frame. Each of the picker assemblies extends along a reference axis and includes a linear array of carding elements, the linear array extending along an axis substantially parallel to the reference axis. Each of the carding elements is resiliently coupled to one of the picker assemblies and is positionable relative to the frame in a resting position and in a picking position. Each of the carding elements includes a base portion and a linear array of substantially parallel, elongated, resilient needle-like elements extending from the base portion to a distal tip. When one of the carding elements is positioned in the resting position, the distal tips of that carding element lie above a picking plane, the picking plane being parallel to the reference axis. When one of the carding elements is positioned in the picking position, the distal tips of that carding element lie substantially in the picking plane. Each pair of picker assemblies includes a first picker assembly and a second picker assembly arranged such that the reference axes of the first and second picker assemblies are substantially parallel. The first and second picker assemblies are further arranged so that the carding elements coupled to the first and second picker assemblies form pairs of carding elements. Each of the pairs of carding elements includes a first carding element disposed adjacent to a second carding element, in which the first carding element is coupled to the first picker assembly, and in which the second carding element is coupled to the second picker assembly. The needle-like elements of the carding elements coupled to the first picker assembly slant towards a first direction, and the needle-like elements of the carding elements coupled to the second picker assembly slant towards a second direction, the second direction being opposite to the first direction. The segment pickup apparatus further includes a carding actuator device for selectively positioning any of the pairs of carding elements in the resting position and in the picking position. The segment pickup apparatus also includes a picker actuator device for selectively displacing any of the picker assemblies relative to the frame in the first direction and in the second direction.

In one preferred embodiment, each of the picker assemblies includes two linear arrays of carding elements, the two linear arrays extending along axes that are substantially parallel to the reference axis of the picker assembly. In another preferred embodiment, each of the picker assemblies comprises a relatively thin apertured metal sheet. In still other embodiments, each of the carding elements may be coupled to a picker assembly by an elongated resilient arm that biases the carding element towards the resting position.

In another embodiment, the frame may be mounted above the picker assemblies. In this embodiment, the carding actuator device may include a shifting device and a platform coupled to the frame between the frame and the picker assemblies. The shifting device selectively shifts the platform along a picking axis which is substantially perpendicular to the reference axis. The shifting device selectively shifts the platform downwards along the picking axis to a first position and upwards along the picking axis to a second position, the first position being closer to the picker assemblies than the second position.

The carding actuator device may further include a plurality of rods slidably mounted to the platform, each of the rods corresponding to one of the pairs of carding elements. Each of the rods has a first end disposed proximal to its corresponding pair of carding elements and a second end disposed proximal to the platform. The platform may define a plurality of apertures, each of the apertures corresponding to one of the rods. Each of the rods may be slidably mounted to the platform, such that each rod slidably extends through its corresponding aperture. In this embodiment, the second end of each rod is disposed above its corresponding aperture and the first end of each rod is disposed below its corresponding aperture. Each of the rods may include a transverse member fixed to the rod above its corresponding aperture for limiting downward movement of the rod through the aperture, and each of the rods may include an L-shaped member mounted to the rod below its corresponding aperture for limiting upward movement of the rod through its corresponding aperture.

The carding actuator device may also include a plurality of coil springs, each of the springs corresponding to one of the rods. Each of the springs may be disposed around its corresponding rod between the L-shaped member and the platform such that each spring biases the first end of its corresponding rod downwards away from the platform.

The carding actuator device may also include a plurality of restraining devices, each of the restraining devices corresponding to one of the rods. Each of the restraining devices may he selectively positionable in a blocking position and in a releasing position. When one of the restraining devices is in the blocking position and when the shifting device then shifts the platform downwards to the first position, the restraining device limits the downward movement of its corresponding rod and prevents the corresponding rod from biasing its corresponding pair of carding elements to the picking position. When one of the restraining devices is in the releasing position and when the shifting device then shifts the platform downwards to the first position, the restraining device permits the rod to move downwards and to bias its corresponding pair of carding elements to the picking position.

In another aspect, the invention provides a picker assembly which may be used in a segment pickup apparatus. The picker assembly includes a central portion which lies substantially in a reference plane. The picker assembly further includes at least one row of elongated resilient arms, each of the arms extending from the central portion to a carding end and each of the carding ends is positionable relative to the central portion in a picking position and in a resting position. Each of the carding ends includes a base portion and a linear array of substantially parallel, elongated, resilient needle-like elements extending from the base portion to a distal tip. When one of the carding ends is positioned in the resting position, the distal tips of that carding end lie above a picking plane, the picking plane being parallel to the reference plane. When one of the carding ends is positioned in the picking position, the distal tips of that carding element lie substantially in the picking plane.

BRIEF DESCRIPTION OF THE DRAWINGS

For a fuller understanding of the nature and the objects of the invention, reference should be made to the following detailed description and the accompanying drawings in which like reference numerals refer to like elements and in which.

DETAILED DESCRIPTION OF THE ILLUSTRATED EMBODIMENT

Figure 1:
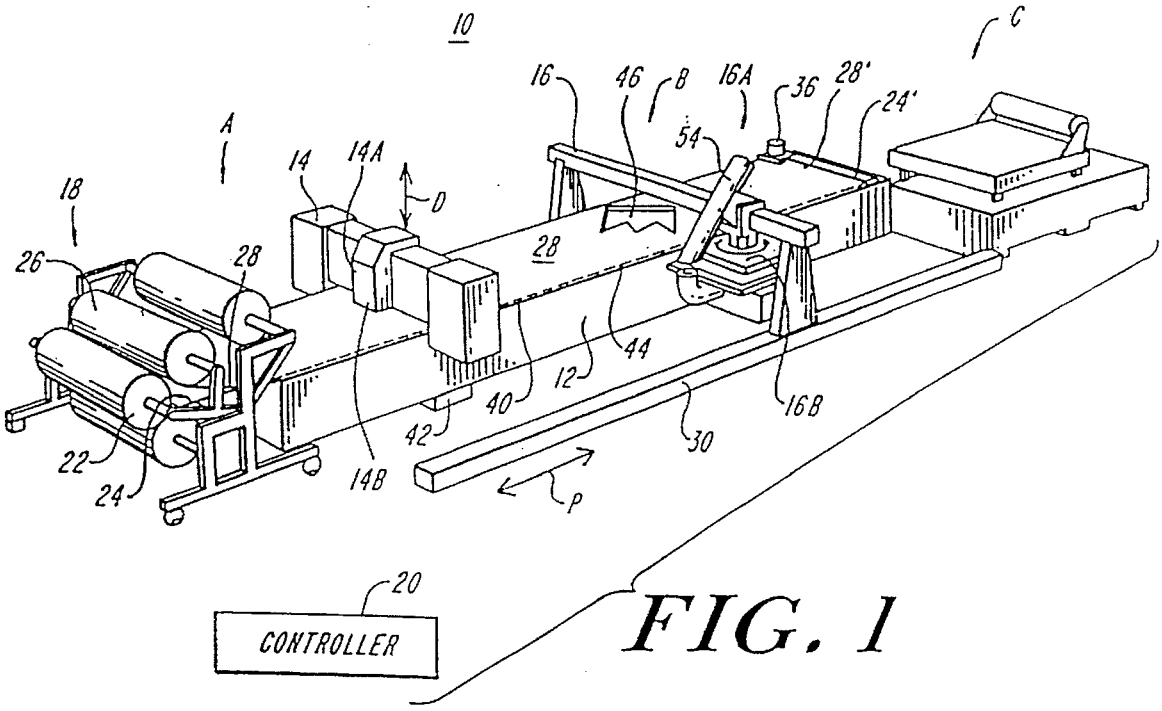
FIG. 1 is an illustration of a system for assembling components from cut material segments which may be used with a segment pickup apparatus constructed according to the invention.

The present invention relates generally to a segment pickup apparatus for picking up and transporting cut material segments. A segment pickup apparatus constructed according to the invention may be used in conjunction with a system for assembling components from cut material segments. Such a system 10 is shown generally in FIG. 1. System 10 is described in detail in the above-referenced U.S. patent application Ser. Nos. 08/027,098 and 08/325,484 and is only briefly described herein. System 10 includes a cutting table 12, a cutting assembly 14, a dispenser assembly 18, and a segment pickup apparatus 16B constructed according to the invention, all of which operate under the control of a controller 20, which may be implemented as a computer, microprocessor, or the like.

Cutting assembly 14 and segment pickup apparatus 16B are both translatably coupled to a set of rails 30 (only one of which is shown) and are motor driven such that controller 20 may selectively position assembly 14 and apparatus 16B at any desired location along rails 30. Segment pickup apparatus 16B is additionally translatably coupled to an overhead rail 22 such that controller 20 may selectively position apparatus 16B at any desired location above cutting table 12.

In operation, cutting assembly 14 grasps one or more ends from the rolls of material at dispenser assembly 18 and puts sheets of material 24 and 26 over the top surface of table 12. Controller 20 then directs cutting assembly 14 to cut sheets 24 and 26 into one or more segments having desired shapes. Controller 20 then positions segment pickup apparatus 16B over one of the cut segments and causes apparatus 16B to pick up the cut segment of sheet 24 and to transport the cut segment to staging area such as the area shown generally at 28. After segment pickup apparatus 16B has picked up a cut segment, a hole having the shape of the cut segment, such as hole 46, will remain in sheet 24. After segment pickup apparatus 16B has picked up a segment and transported it to staging area 28, controller 20 causes apparatus 16B to drop the cut segment at a desired location on staging area 28.

Figure 2A:
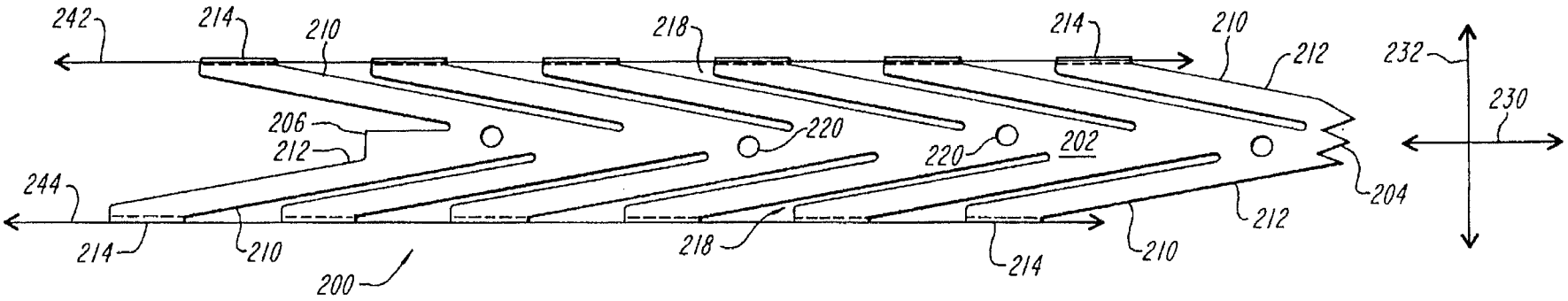
FIG. 2A is a top view of a picker assembly constructed according to the invention.
Figure 2B:
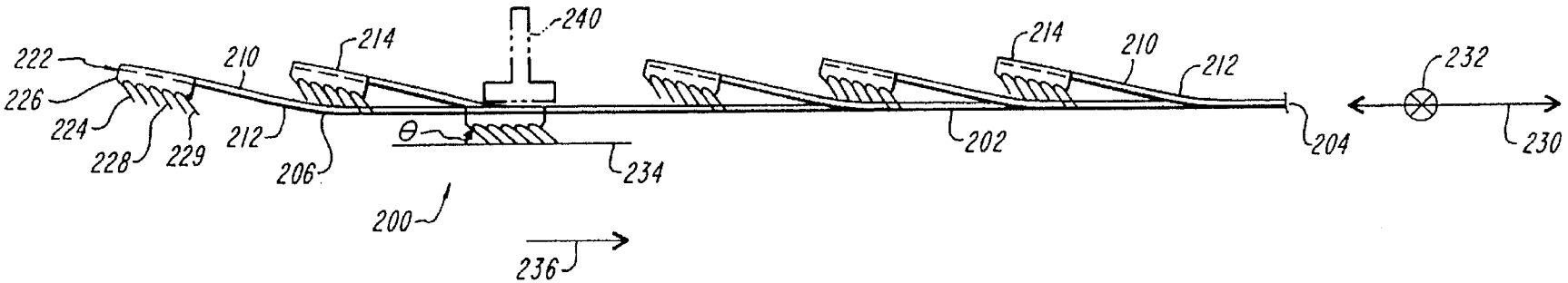
FIG. 2B is a front sectional view of the picker assembly shown in FIG. 2A showing one of the carding elements positioned in the picking position and the other carding elements positioned in the resting position.

As will be described in more detail below, segment pickup apparatus 16B is preferably constructed using a plurality of picker assemblies. FIGS. 2A and 2B are top, and front sectional views, respectively, of one embodiment of a preferred picker assembly 200 constructed according to the invention. Picker assembly 200 includes a central portion 202 extending along a reference axis 230 from an inner end 204 to an outer end 206. Central portion 202 substantially lies in a reference plane defined by reference axis 230 and an axis 232 that is normal to reference axis 230 (and is parallel to the plane of the page in FIG. 2A and normal to the plane of the page in FIG. 2). Picker assembly 200 further includes two rows of elongated, resilient arms 210 extending along opposite sides of central portion 202. Each arm 210 is integral to assembly 200, and extends from a central end 212, where it joins central portion 202, to a carding end 214. As shown in FIG. 2A, each arm 210 is separated from its adjacent arms by an elongated narrow aperture 218. A set of hole-like apertures 220 may also be formed in central portion 202 to reduce the weight of assembly 200 and to facilitate mounting assembly 200 to a frame (not shown).

As shown in FIG. 2B, each carding end 214 terminates in a carding element 222. One carding element 222 will now be described, however, it should be appreciated that since all of the carding elements are substantially similar, this description will serve to describe all of the carding elements. Carding element 222 includes a base portion 226 and a linear array of substantially parallel, elongated, resilient needle-like elements 224. In other forms of the invention, different shaped arrays, such as rectangular, may be used.

The base portion 226 extends from arm 210 and each of the needle-like elements 224 extends from the base portion 226 to a distal tip 228. Each of the needle-like elements 224 is separated from its adjacent needle-like elements by an aperture 229. Base portion 226 preferably extends at a right angle from arm 210 such that all of the needle-like elements 224 lie substantially in a plane that is normal to the reference plane determined by axes 230 and 232.

Each arm 210 resiliently couples its carding element 222 to the assembly 200 such that each carding element 222 is positionable relative to central portion 202 in a resting position and in a picking position. As shown in FIG. 2B, each of the arms 210, when not subject to an external force, extends upwards from the reference plane thereby placing its carding element 222 in the resting position above the reference plane defined by axes 230 and 232. A plunger 240, or other actuating device, may displace one of the carding elements 222 relative to the reference plane and central portion 202 thereby flexing resilient arm 210 and placing the carding element 222 in the picking position. When plunger 240 is removed, the resilient arm 210 returns to its natural position extending upwards from the reference plane, thereby returning the carding element 222 to the resting position.

When a carding element 222 is positioned in the picking position, as illustrated in FIG. 2B for the third picker from the left, the distal tips 228 of that carding element preferably lie substantially in a picking plane 234 which is preferably parallel to, and spaced apart from, the reference plane. Further, when in the picking position, each of the needle-like elements 224 form an offset angle θ (theta) with the picking plane 234. When in the picking position, each of the needle-like elements may be thought of as slanting towards an offset direction, shown by arrow 236, towards the first end 204. When in the resting position, all of the distal tips 228 preferably lie above the picking plane.

As shown in FIG. 2A, assembly 200 has two linear arrays of carding elements extending along opposite sides of central portion 202, one of the arrays extending along an axis 242, and the other array extending along an axis 244, both axes 242, 244 preferably being parallel to reference axis 230. In one preferred embodiment, the two arrays each contain forty-eight carding elements such that assembly 200 contains a total of ninety-six carding elements.

Figure 3B:
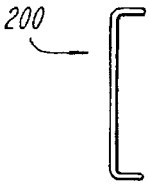
FIGS. 3A and 3B are top and side views, respectively, of the picker assembly shown in FIGS. 2A and 2B during various stages of construction.
Figure 3A:
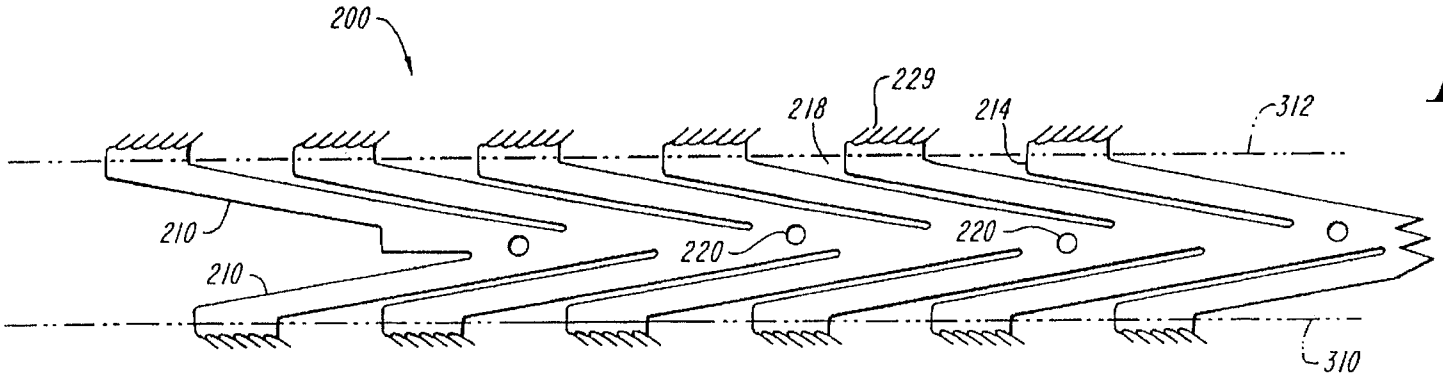

Picker assembly 200 may be fabricated from a relatively thin, flat sheet of metal as shown in FIGS. 3A and 3B, which are, respectively, top and side views of assembly 200 during various stages of construction. Picker assembly 200 is preferably formed by subjecting a flat sheet of metal to a chemical etching process to form apertures 218, 220, 229, and thereby generate the flat pattern shown in FIG. 3A, however as those skilled in the art will appreciate, the apertures may alternatively be formed by cutting or stamping a sheet of metal, or by other means. After apertures 218, 220, 229 have been formed, each of the carding ends 214 is bent, preferably by ninety degrees, along bend lines 310, 312 so that the assembly has the side profile shown in FIG. 3B. Each of the arms 210 is then bent upwards so that the natural resting position of each carding element 222 is above the reference plane as shown in FIG. 2B.

Figure 4:
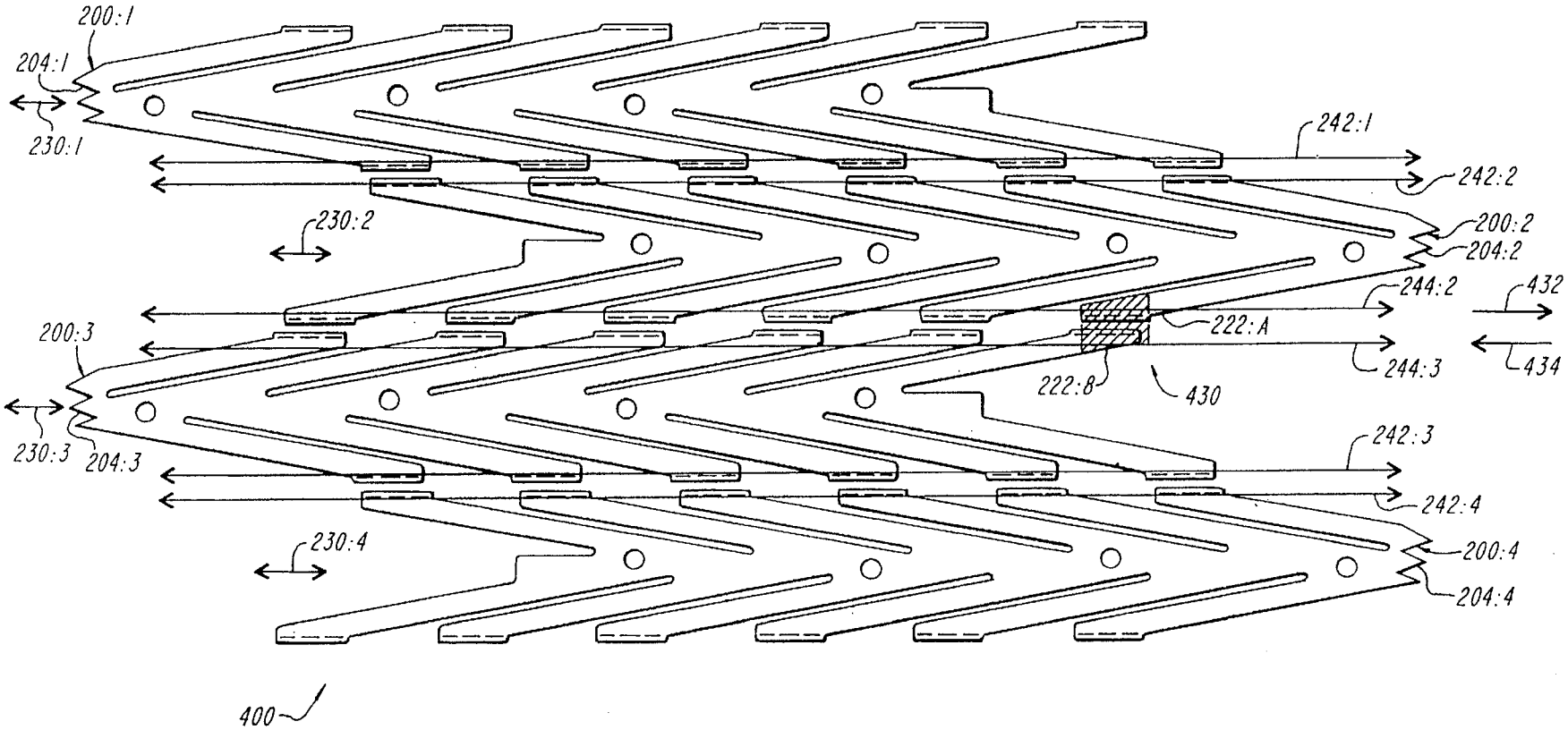
FIG. 4 is a top view of a picking array constructed according to the invention using several picker assemblies of the type shown in FIGS. 2A and 2B.

As shown in FIG. 4, a picking array 400 may be assembled according to the invention from a plurality of picker assemblies 200. As will be discussed further below, picking array 400 may be used in accordance with the invention to construct segment pickup apparatus 16B (shown in FIG. 1). FIG. 4 shows four picker assemblies 200:1, 200:2, 200:3, and 200:4 being used to form picking array 400, however as those skilled in the art will appreciate, more or even fewer picker assemblies may be used. The two linear arrays of carding elements of picker assembly 200:2 extend along axes 242:2, 244:2, and similarly the two linear arrays of carding elements of picker assembly 200:3 extend along axes 242:3, 244:3. One of the arrays of carding elements of picker assembly 200:1 extends along axis 242:1 and one of the arrays of carding elements of picker assembly 200:4 extends along axis 242:4. The four picker assemblies are preferably arranged so that axes 242:1, 242:2, 244:2, 244:3, 242:3, and 242:4 are all parallel. The four picker assemblies are further preferably arranged so that the first ends 204:1, 204:3 of picker assemblies 200:1, 200:3 are disposed opposite the first ends 204:2, 204:4 of picker assemblies 200:2, 200:4, and such that axes 242:1 and 242:2 are adjacent, and such that axes 244:2 and 244:3 are adjacent, and such that axes 242:3 and 242:4 are adjacent. In this configuration, the needle-like elements of carding elements in adjacent arrays are disposed in a preferable arrangement in which they form equal and opposite offset angles with respect to the picking plane when positioned in the picking position. For example, the needle-like elements of the carding elements in the array extending along axis 244:2 slant towards a direction indicated by arrow 432 towards first end 204:2 and the needle-like elements of the carding elements in the adjacent array, which extends along axis 244:3, slant towards the opposite direction as indicated by arrow 434 towards first end 204:3.

In picking array 400, the carding elements 222 are preferably arranged in pairs such that each carding element in one array is paired with, and is adjacent to, a carding element in the adjacent array, as exemplified by a pair 430 of carding elements including carding element 222:A, which is attached to picker assembly 200:2 and carding element 222:B, which is attached to picker assembly 200:3. In each pair of carding elements, the needle-like elements of one carding element have an offset angle, with respect to the picking plane, that is opposite to the offset angle of the other carding element, i.e., the needle-like elements of one carding element slant towards the direction indicated by arrow 432 and the needle-like elements of the other carding element slant towards the direction indicated by arrow 434. In one preferred embodiment, picking array 400 is constructed using forty-nine picker assemblies 200, each of which have two arrays of forty-eight carding elements. In this embodiment, picking array 400 provides a two dimensional array of forty-eight by forty-eight pairs of carding elements (i.e., 2304 pairs of carding elements).

Figure 5A:
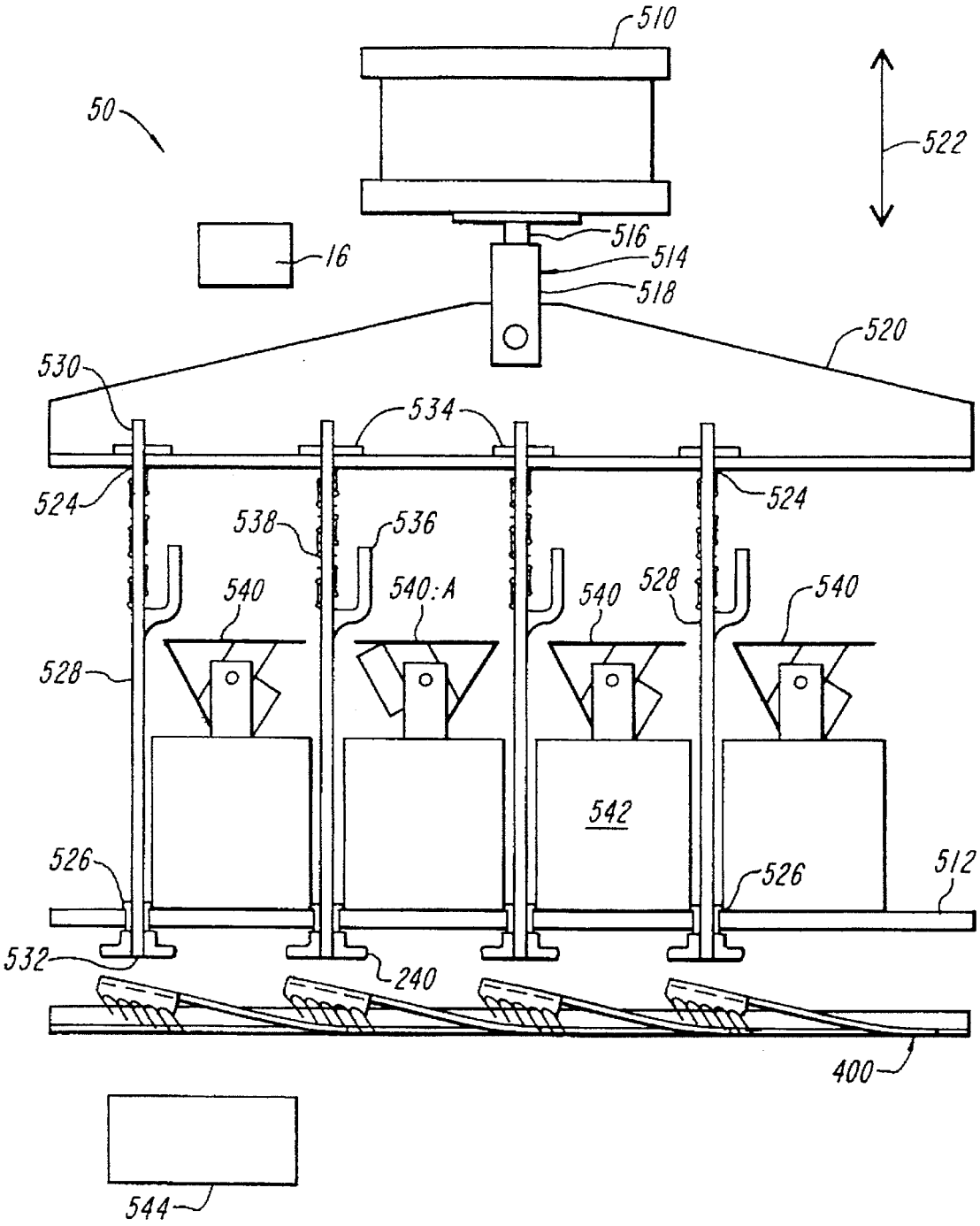
FIGS. 5A and 5B are sectional views of a segment pickup apparatus constructed according to the invention using the picking array shown in FIG. 4.
Figure 5B:
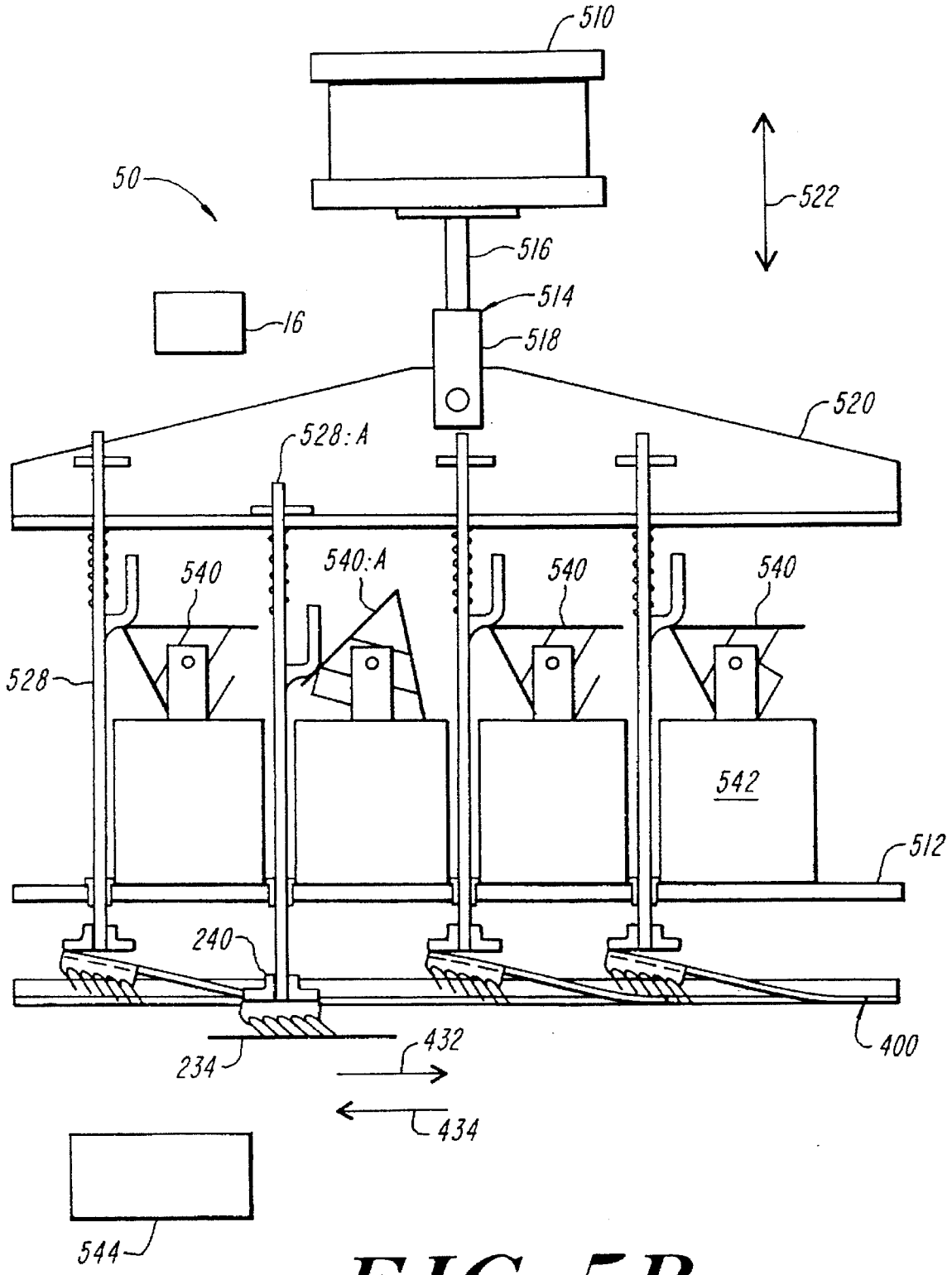

FIGS. 5A–B are from sectional views of one preferred embodiment of a segment pickup apparatus 16B constructed according to the invention. Apparatus 16B includes a frame 510 that is preferably rigidly coupled to picking array 400 which is configured substantially as shown in FIG. 4. Frame 510 is also preferably rigidly coupled to a board 512 which is disposed parallel to picking array 400 and between picking array 400 and frame 510. The position of frame 510 relative to table 12 (shown in FIG. 1) may be controlled by controller 20. Frame 510 is also coupled to an actuator 514, which may be implemented as a pneumatic actuator, or a hydraulic actuator, or the like. Under the control of controller 20, actuator 514 selectively translates a rigid platform 520 in the direction of an axis 522 to an upper holding position as shown in FIG. 5A or to a lower grasping position as shown in FIG. 5B. In the illustrated embodiment, actuator 510 includes a piston 516 and a cylinder 518. Piston 516 is rigidly coupled to frame 510 and cylinder 518 is in turn rigidly coupled to platform 520.

Platform 520 defines a plurality of apertures 524 and board 512 defines a corresponding plurality of apertures 526. Apertures 524, 526 are arranged in pairs so that each aperture 524 is paired with one corresponding aperture 526. Segment pickup apparatus 16B further includes a plurality of rods 528, each of which includes an upper end 530 and a lower end 532. Each of the rods 528 is disposed vertically so that its upper end 530 extends through an aperture 524 of platform 520 and its lower end 532 extends through a corresponding aperture 526 of board 512. A plunger 240 is fixed to lower end 532 of each rod below aperture 526. A transverse member 534 is fixed to upper end 530 of each rod 528 above aperture 524. Transverse member 534 is chosen to be larger than aperture 524 so that it limits the downward motion of rod 528 relative to platform 520. An L-shaped member 536 is fixed to each rod 528 below aperture 524 and similarly limits the upward motion of rod 528 relative to platform 520. L-shaped member 536 and transverse member 534 therefore trap rod 528 within aperture 524 such that rod 528 is slidably positionable within aperture 524 in a range defied by the space between transverse member 534 and L-shaped member 536. A resilient bias element, such as a coil spring 538, is preferably disposed around each rod 528 between L-shaped member 536 and platform 520 such that spring 538 exerts a force against platform 520 and thereby biases rod 528 downwards forcing transverse member 534 against platform 520 and thereby biasing lower end 532 downwards away from platform 520. In this arrangement, downward movement of platform 520 tends to cause downward movement of rods 528.

Board 512, platform 520 and rods 528 are arranged so that each plunger 240 is disposed proximal to an adjacent pair of carding elements of picking array 400, such as pair 430 (shown in FIG. 4). As shown in FIG. 5B, when one rod 528 is biased downwards it positions a corresponding pair of carding elements in the picking position such that the distal tips of the needle-like elements all lie substantially in the picking plane 234. Since FIG. 5B is a sectional view, only one carding element is shown in the picking position, however, it will be appreciated that an adjacent carding element with needle-like elements having an offset angle that is opposite to the offset angle of the carding element shown in the figure is also positioned in the picking position by rod 528.

As shown in FIGS. 5A–B, segment pickup apparatus 16B also includes a plurality of restraining devices 540. Each restraining device 540 is pivotally mounted to a stand 542 which is in turn rigidly fixed to board 512 such that each restraining device 540 may pivot between a blocking position and a releasing position. In FIG. 5A, restraining device 540:A is shown in the releasing position, and all the other restraining devices 540 are shown in the blocking position. Once positioned in the blocking position, restraining device 540 will not rotate further in the counterclockwise direction, and once positioned in the releasing position, restraining device 540 will rotate freely in the counterclockwise direction. Preferably, a plurality of electronically controlled magnetic relays (shown in, and discussed below in connection with, FIG. 6) are used to selectively position each of the restraining devices in either the blocking position or the releasing position. These relays are preferably disposed on board 512 and are controlled by controller 20. As described above, in one preferred embodiment, picking array 400 provides a two dimensional array of forty-eight by forty-eight pairs of carding elements (i.e., 2304 pairs of carding elements). This preferred embodiment of picking array 400, may be used to construct a preferred segment pickup apparatus which has 2304 rods 528 and 2304 restraining devices 540.

Initial downward movement of a rod 528 from the position shown in FIG. 5A causes L-shaped member 536 to contact restraining device 540 and then further downward movement of rod 528 causes L-shaped member 536 to exert a force against restraining device 540 tending to make restraining device 540 rotate in a counterclockwise direction. Therefore, when a restraining device 540 is positioned in the blocking position, downward movement of platform 520 relative to array 400 will bias a rod 528 downwards until L-shaped member 536 contacts restraining device 540. Further downward movement of platform 520 will not cause further downward movement of rod 528 since restraining device 540 prevents further downward movement of rod 528 relative to board 512. Further downward movement of platform 520 instead causes compression of spring 538 and causes the upper portion of rod 528 to slide upwards through aperture 524 as shown by three of the rods 528 in FIG. 5B. Conversely, when a restraining device such as restraining device 540:A is positioned in the releasing position, downward movement of platform 520 will bias rod 528:A downwards as shown in FIG. 5B such that plunger 240 positions a pair of carding elements in the picking position. By selectively positioning the restraining devices 540 in either the blocking position or the releasing position, controller 20 may selectively position any pair of carding elements in either the picking position or the resting position.

Figure 6:
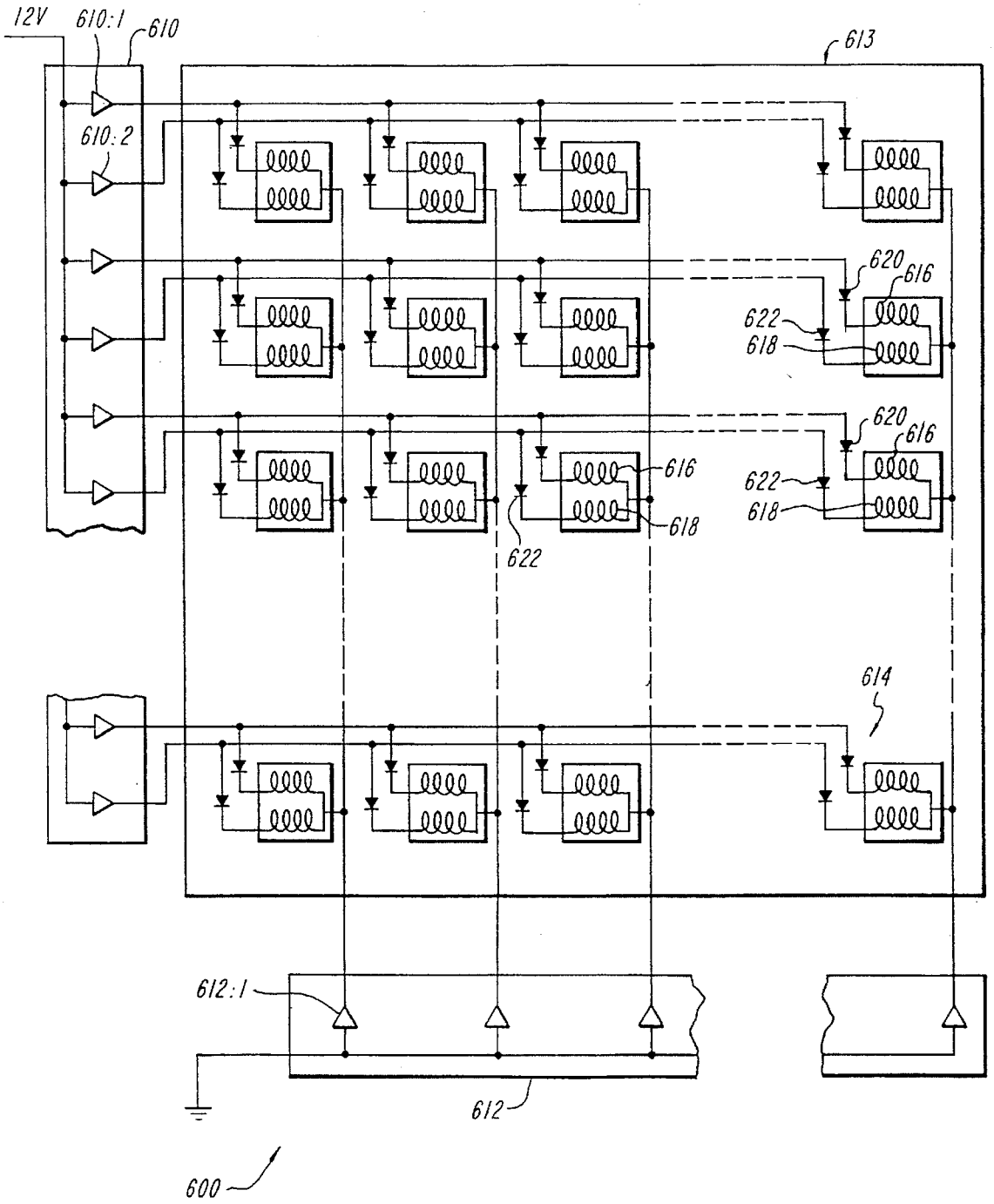
FIG. 6 is a schematic of a preferred circuit for controlling the position of the restraining devices used in the segment pickup apparatus shown in FIG. 5.

FIG. 6 is a schematic of one circuit 600 which may be used for controlling the position of the restraining devices 540 (shown in FIGS. 5A–B). Circuit 600 includes a column 610 of current sources, a row 612 of current sinks, and a two dimensional array 613 of trigger elements 614. Each trigger element 614 includes two magnetic relays 616, 618, two diodes 620, 622, and has a blocking input, a releasing input, and a trigger output. Each relay 616 is coupled between diode 620 and the trigger output, and each relay 618 is coupled between diode 622 and the trigger output. Each diode 620 is coupled between the blocking input and relay 616 and is oriented to allow current to flow from the blocking input through relay 616 to the trigger output. Similarly, each diode 622 is coupled between the releasing input and relay 618 and is oriented to allow current to flow from the releasing input through relay 618 to the trigger output. The first current sink 612:1 in row 612 is coupled to all the trigger outputs of the trigger elements 614 in the first column of array 613. Similarly, the trigger outputs of the trigger elements 614 in each column of array 613 are coupled to one of the current sinks in row 612. The first current source 610:1 in column 610 is coupled to all of the blocking inputs in the first row of trigger elements 614 in array 613, and the second current source 610:2 in column 610 is coupled to all of the releasing inputs in the first row of trigger elements 614 in array 613. Similarly, the blocking and releasing inputs of all of the trigger elements 614 in each row of array 613 are coupled to two of the current sources in column 610.

Circuit 600 is preferably distributed so that each trigger element 614 is positioned near one of the restraining devices 540 (shown in FIG. 5) so that a current flowing through the blocking input of one trigger element 614 (and therefore also through relay 616) generates a magnetic field that causes one restraining device 540 to pivot into the blocking position, and so that a current flowing through the releasing input of one trigger element 614 (and therefore also through relay 618) generates a magnetic field that causes one restraining device to pivot into the releasing position. Controller 20 may selectively position any of the restraining devices 540 in either the releasing position or the blocking position by selectively activating the current sources and sinks. In one preferred embodiment of segment pickup apparatus 16B which contains an array of forty-eight by forty-eight pairs of carding elements (i.e., 2304 pairs of carding elements) array 613 contains an array of forty-eight by forty-eight trigger elements 614 (i.e., 2304 trigger elements 614). In this embodiment, column 610 contains ninety-six (i.e., forty-eight times two) current sources, and row 612 contains forty-eight current sinks. In this embodiment column 610 may be preferably implemented by using four FP28000A integrated circuit chips, each chip being configured to provide twenty-four current sources, and row 612 may be preferably implemented by using two FP28000A integrated circuit chips, each chip being configured to provide twenty-four current sinks.

In operation, controller 20 positions segment pickup apparatus 16B over cutting table 12 (shown in FIG. 1) such that a sheet of material containing one or more segments lies substantially in the picking plane 234. To pick up a single cut segment, controller 20 first determines which pairs of carding elements are directly above the cut segment. Controller 20 may make this determination since controller 20 has previously controlled the operation of cutting assembly 14 (shown in FIG. 1) and controller 20 therefore knows the precise location and shape of each cut segment. Controller 20 then positions each restraining device corresponding to those pairs of carding elements that are above the cut segment in the releasing position, and positions all other restraining devices in the blocking position. Controller 20 then activates actuator 514 to drive platform 520 downwards to the grasping position as shown in FIG. 5B. This positions the pairs of carding elements that are over the cut segment in the picking position such that the distal tips of all of those carding elements contact the cut segment. All other carding elements remain in the resting position and therefore do not disturb other cut segments surrounding the segment of interest or the scrap. As will be described in more detail below, it is preferable that only those carding elements which completely overlie the cut segment be positioned in the picking position. Any carding elements which partially overlie the cut segment and which partially overlie surrounding cut segments or scrap preferably remain in the resting position.

Segment pickup apparatus 16B then grasps the cut segment by using actuator 544 to selectively translate, under the control of controller 20, the picker assemblies. In each pair of carding elements that contact the cut segment, one of the carding elements (such as the carding element in the picking position shown in FIG. 5B) has needle-like elements which slant towards a direction indicated by arrow 432, and the other carding element of the pair (not shown in FIG. 5B) has needle-like elements which slant towards the opposite direction indicated by arrow 434. Controller 20 controls grasping by translating half of the picker assemblies in the direction of arrow 432 and translating the other half of the picker assemblies in the direction of arrow 434. The picker assemblies translated in the direction of arrow 432 are those that have their needle-like elements slanting towards the direction of arrow 432, and similarly, the picker assemblies translated in the direction of arrow 434 are those that have their needle-like elements slanting towards the direction of arrow 434. This translation of the picker assemblies causes the needle-like elements in contact with the cut segment to penetrate and thereby grasp the cut segment. Preferably, the picker assemblies are only translated sufficiently to cause the needle-like elements to slightly penetrate the surface of the cut segment.

Controller 20 then raises frame 510 and thereby raises the cut segment above the material sheet. Controller 20 then translates frame 510 so as to precisely position segment pickup apparatus 16B over the a desired portion of the staging area and then causes apparatus 16B to drop the cut segment. Dropping is accomplished by using actuator 544 to translate each of the picker assemblies in a direction opposite to the direction in which they were translated to grasp the cut segment. This causes each of the needle-like elements to withdraw from the cut segment and thereby release the segment.

The above-referenced U.S. patent application Ser. No. 08/027,098 described a system for picking up cut segments which uses two sheets of material. As those skilled in the art will appreciate, this system may also be used in conjunction with the present invention. Referring to FIG. 1, in such a system a first sheet of material, referred to as the target sheet, is spread over cutting table 12 and a second sheet, referred to as the protective sheet, is spread over the target sheet. The protective sheet is fabricated from a material, such as smooth plastic, which is not penetrable by the needle-like elements of the carding elements. Once the two sheets have been spread over cutting table 12, cutting assembly 14 cuts segments of desired shapes out of the target sheet, and since the protective sheet overlies the target sheet, the cutting gantry simultaneously cuts correspondingly shaped segments out of the protective sheet. To pick up a single segment of interest which has been cut from the target sheet, a vacuum device is first used to remove the corresponding segment cut from the protective sheet which overlies the segment of interest. Once this corresponding segment of the protective sheet has been removed, the protective sheet covers all of the target sheet except for the cut segment of interest. Controller 20 then positions segment pickup apparatus 16B over the cut segment of interest. Segment pickup apparatus 16B then picks up the segment in the manner described above. However, in this system, if a carding element partially overlies the cut segment of interest and partially overlies other portions of the target sheet, (or even totally overlies other portions of the target sheet) this carding element may also be positioned in the picking position during a picking operation. This is so because any needle-like elements which do not overlie the cut segment will not contact the target sheet and will therefore not disturb other cut segments or the scrap. Needle-like elements in the picking position which do not overlie the cut segment of interest contact only the protective sheet and do not contact the target sheet. Since the needle-like elements do not penetrate the protective sheet they will not disturb any portions of the target sheet lying below the protective sheet. This system can be particularly advantageous when picking up relatively small segments and can be used to pick up segments that are smaller than a single carding element.

The picker assemblies 200 (shown for example in FIG. 2) have been described as having a linear array of carding elements. As those skilled in the art will appreciate, the invention will also function well even if arms 210 are of different lengths and the carding elements 222 are therefore not arranged in a linear array. Similarly, the carding elements have been described as having needle-like elements which lie in a plane that is perpendicular to the reference plane. As those skilled in the art will appreciate, the invention will also function well if the needle-like elements form an angle of other than ninety degrees with the reference plane. Similarly, the invention has been described as being used in conjunction with system 10, shown in FIG. 1. As those skilled in the art will appreciate, the invention may also be used in conjunction with other systems for handling material segments.

Therefore, the invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

Having described the invention, what is claimed as new and secured by Letters Patent is:

1. A segment pickup apparatus comprising:

A. a frame;

B. at least one pair of elongated picker assemblies coupled to said frame, each of said picker assemblies extending along a reference axis and including a linear array of carding elements extending along an axis substantially parallel to said reference axis, each of said carding elements being resiliently coupled to one of said picker assemblies and being positionable relative to said frame in a resting position and in a picking position, each of said carding elements including a base portion and a linear array of substantially parallel, elongated, resilient needle-like elements extending from said base portion to a distal tip such that when any one of said carding elements is positioned in said resting position, the distal tips of that carding element lie above a picking plane, said picking plane being parallel to said reference axis, and when any one of said carding elements is positioned in said picking position, the distal tips of that carding element lie substantially in said picking plane, each of said pairs of picker assemblies including a first picker assembly and a second picker assembly arranged so that said reference axis of said first picker assembly is substantially parallel to said reference axis of said second picker assembly and so that said carding elements coupled to said first and second picker assemblies form pairs of carding elements, each of said pairs of carding elements including a first carding element disposed adjacent to a second carding element, said first carding element being coupled to said first picker assembly and said second carding element being coupled to said second picker assembly, the needle-like elements of all of the carding elements coupled to said first picker assembly slanting towards a first direction and the needle-like elements of all of the carding elements coupled to said second picker assembly slanting towards a second direction opposite to said first direction;

C. carding actuator means for selectively positioning any of said pairs of carding elements in said resting position and in said picking position; and D. picker actuator means for selectively displacing any of said picker assemblies relative to said frame in said first direction and in said second direction.

2. A segment pickup apparatus according to claim 1, wherein each of said picker assemblies includes two linear arrays of carding elements, each of said arrays extending along an axis substantially parallel to said reference axis.

3. A segment pickup apparatus according to claim 1, wherein each of said picker assemblies comprises a relatively thin apertured metal sheet.

4. A segment pickup apparatus according to claim 1, wherein each of said carding elements is coupled to one of said picker assemblies by an elongated resilient arm that biases said carding element towards said resting position.

5. A segment pickup apparatus according to claim 1, wherein said frame is mounted above said picker assemblies.

6. A segment pickup apparatus according to claim 5, wherein said carding actuator means comprises a platform coupled to said frame between said frame and said picker assemblies and shifting means for selectively shifting said platform downwards along a picking axis substantially perpendicular to said reference axis to a first position and for selectively shifting said platform upwards along said picking axis to a second position, said first position being closer to said picker assemblies than said second position.

7. A segment pickup apparatus according to claim 6, wherein said carding actuator means further comprises a plurality of rods slidably mounted to said platform, each of said rods corresponding to one of said pairs of carding elements and each of said rods having a first end disposed proximal to its corresponding pair of carding elements and a second end disposed proximal to said platform.

8. A segment pickup apparatus according to claim 7, wherein said platform defines a plurality of apertures, each of said apertures corresponding to one of said rods, each of said rods slidably extending through its corresponding aperture, the second end of each rod being disposed above its corresponding aperture and the first end of each rod being disposed below its corresponding aperture, each of said rods including a transverse member fixed to the rod above its corresponding aperture for limiting downward movement of the rod through its corresponding aperture, and each of said rods including an L-shaped member fixed to the rod below its corresponding aperture for limiting upward movement of the rod through its corresponding aperture.

9. A segment pickup apparatus according to claim 8, wherein said carding actuator means further comprises a plurality of coil springs, each of said springs corresponding to one of said rods, each of said springs being disposed around its corresponding rod between said L-shaped member and said platform such that said spring biases said first end of its corresponding rod downwards away from said platform.

10. A segment pickup apparatus according to claim 9, wherein said carding actuator means further comprises a plurality of restraining devices, each of said restraining devices corresponding to one of said rods and each of said restraining devices being selectively positionable in a blocking position and in a releasing position, such that when one of said restraining devices is in said blocking position and said shifting means then shifts said platform downwards to said first position said one restraining device limits downward movement of its corresponding rod and prevents said corresponding rod from biasing its corresponding pair of carding elements to said picking position, and such that when one of said restraining devices is in said releasing position and said shifting means then shifts said platform downwards to said first position said one restraining device permits said rod to move downwards and bias its corresponding pair of carding elements to said picking position.

11. A segment pickup apparatus comprising:

A. a frame;

B. at least one pair of elongated picker assemblies coupled to said frame, each of said picker assemblies including an array of carding elements, each of said carding elements being resiliently coupled to one of said picker assemblies and being positionable relative to said frame in a resting position and in a picking position, each of said carding elements including a base portion and a linear array of substantially parallel, elongated, resilient needle-like elements extending from said base portion to a distal tip such that when any one of said carding elements is positioned in said resting position, the distal tips of that carding element lie above a picking plane, and when any one of said carding elements is positioned in said picking position, the distal tips of that carding element lie substantially in said picking plane, each of said pairs of picker assemblies including a first picker assembly and a second picker assembly arranged so that said carding elements coupled to said first and second picker assemblies form pairs of carding elements, each of said pairs of carding elements including a first carding element disposed adjacent to a second carding element, said first carding element being coupled to said first picker assembly and said second carding element being coupled to said second picker assembly, the needle-like elements of all of the carding elements coupled to said first picker assembly slanting towards a first direction and the needle-like elements of all of the carding elements coupled to said second picker assembly slanting towards a second direction opposite to said first direction;

C. carding actuator means for selectively positioning any of said pairs of carding elements in said resting position and in said picking position; and D. picker actuator means for selectively displacing any of said picker assemblies relative to said frame in said first direction and in said second direction.

12. A picker assembly comprising:

A. a central portion lying substantially in a reference plane;

B. at least one row of elongated resilient arms, each of said arms extending from said central portion to a carding end, each of said carding ends being positionable relative to said central portion in a picking position and in a resting position, each of said carding ends including a base portion and a linear array of substantially parallel, elongated, resilient needle-like elements extending from said base portion to a distal tip such that when any one of said carding ends is positioned in said resting position each of said distal tips of that carding end lie above a picking plane, said picking plane being substantially parallel to said reference plane, and when any one of said carding ends is positioned in said picking position each of said distal tips of that carding end lie substantially in said picking plane.

* * * * *